US007044576B2

(12) United States Patent
Kune et al.

(10) Patent No.: US 7,044,576 B2
(45) Date of Patent: May 16, 2006

(54) MACHINE ADJUSTMENT DEVICE AND METHOD OF ADJUSTING MACHINE

(75) Inventors: Yoshiharu Kune, Nagano-ken (JP); Koichi Nishiwaki, Nagano-ken (JP); Takahiro Minamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 227 days.

(21) Appl. No.: 10/698,155

(22) Filed: Oct. 31, 2003

(65) Prior Publication Data

US 2004/0138764 A1 Jul. 15, 2004

(30) Foreign Application Priority Data

Oct. 31, 2002 (JP) ..... 2002-317447

(51) Int. Cl.
*B41J 29/393* (2006.01)

(52) U.S. Cl. ..... 347/19

(58) Field of Classification Search ..... 347/5, 347/19, 179–180, 195, 9, 14; 399/24–25, 399/31, 46–49, 76, 81
See application file for complete search history.

(56) References Cited

U.S. PATENT DOCUMENTS 5,835,817 A * 11/1998 Bullock et al. ..... 399/25
6,198,885 B1 * 3/2001 Budnik et al. ..... 399/24

* cited by examiner

*Primary Examiner*—Hai Pham
(74) *Attorney, Agent, or Firm*—Martine Penilla & Gencarella, LLP

(57) ABSTRACT

The machine adjustment device of the invention displays a list of components constituting a printer in a sequential manner and asks the user to select one or multiple components to be removed or replaced. The machine adjustment device extracts adjustment parameters, which require adjustment accompanied with removal or replacement of the one or multiple selected components, and sets an adjustment order of the extracted adjustment parameters. The machine adjustment device outputs display of an adjustment window including the extracted adjustment parameters in the preset adjustment order and interactively executes adjustment of the printer with operations of the user. This arrangement enables even an unskilled user to implement easy, quick, and adequate adjustment required in the case of removal or replacement of the components in the printer.

20 Claims, 15 Drawing Sheets

FIG. 2

| Component Name | Job | Adjustment Parameter 1 | Adjustment Parameter 2 | Adjustment Parameter 3 | ... |
|---|---|---|---|---|---|
| Print Head | Removed | Waste Ink Pad Counter | Head Angular Adjustment | Bi-D Adjustment | ... |
| Print Head | Replaced | Waste Ink Pad Counter | Head Adjustment | Regulation of Ink Charge | ... |
| ... | ... | ... | ... | ... | ... |
| ... | ... | ... | ... | ... | ... |

FIG. 3

| Adjustment Parameter | Adjustment Order | Relevant Matters |
|---|---|---|
| Waste Ink Pad Counter | n1 | abc1*** |
| Head Angular Adjustment | n2 | abc2*** |
| Bi-D Adjustment | n3 | abc3*** |
| A4 Check Pattern Print | n4 | abc4*** |
| ... | ... | ... |

FIG. 13

58

Content | Key Word | Back | Print

Head Angular Adjustment

1.Explanation

This adjustment is made to correct physically the assembling error of the Printhead relative to the CR unit.

2. Disassembly and Reassembly Requiring this adjustment
-Printhead (removal and replacement )
-Printer mechanism (replacement )

3. How To Adjust
NOTE:
Do not attach the upper case during the head angular adjustment.
Step 1.
Turn on the printer if you have turned off the printer once at before "Ink charge" operation.
Step 2.
Once you can find stand-by mode,press "Print"button to print the head angular pattern.
Step 3.
(Printer starts printing,and completely ejects printed-paper.)You can see following print pattern.Then,completion message will appear on the program screen.Press "OK"button.

Head Angular Pattern

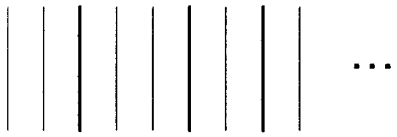

MACHINE ADJUSTMENT DEVICE AND METHOD OF ADJUSTING MACHINE

BACKGROUND OF THE INVENTION

1. Field of the Invention

The present invention relates to a machine adjustment device and a machine adjustment method. More specifically, The invention relates to a machine adjustment device that adjust a machine, and a corresponding method.

2. Description of the Prior Art

Required adjustment in connection with replacement of a component is generally carried out in a precision machine that requires diverse adjustment to exert expected functions against a manufacturing variation of the component, for example, a high-performance color printer. Each component to be replaced has different adjustment parameters as objects of adjustment. In order to avoid slippage of some adjustment, required adjustment parameters and its procedure corresponding to each component to be replaced are specified in the form of manuals. For application of this invention, we had examined the prior art technique relating to such adjustment of the device, but did not find any cited references.

The user carries out adjustment by referring to the manuals of the required adjustment parameters and its procedure corresponding to each component to be replaced. When there are a number of required adjustment parameters, the user may slip over some of the adjustment parameters. This does not ensure appropriate adjustment of the machine. In many cases, the number of adjustment parameters required for detachment of a component and reattachment of the component after cleaning or another operation is typically less than the number of adjustment parameters required for detachment of an old component and attachment of a new component as replacement of the detached component. This is because the component itself is not changed in the former case. According to the manuals, the user may needlessly execute adjustment of the adjustment parameters that are required for only the replacement of the component. This undesirably worsens the efficiency of adjustment. In the case of replacement of multiple components, the user should read the manuals to find the required adjustment parameters and its procedure corresponding to each of the multiple components and carry out the adjustment. This is undesirably time- and labor-consuming.

SUMMARY OF THE INVENTION

The machine adjustment device and the corresponding machine adjustment method of the invention aim to ensure quick adjustment required in the case of removal or replacement of a component in a machine. The machine adjustment device and the corresponding machine adjustment method of the invention also aim to enable even an unskilled user to readily implement adjustment required in the case of removal or replacement of a component in the machine. The machine adjustment device and the corresponding machine adjustment method of the invention further aim to be applicable for removal or replacement of multiple components.

In order to achieve at least a part of the aforementioned objects, a machine adjustment device of the present invention is structured as follows.

A machine adjustment device of the present invention is a machine that adjusts a machine, the machine adjustment device including: a connector module that connects with a controller of the machine in a communicable manner; a component selection module that selects an object component to be detached among components of the machine; an adjustment parameter setting module that sets at least one adjustment parameter, which requires adjustment accompanied with detachment of the selected object component, as well as an adjustment order of the at least one adjustment parameter; and an adjustment execution module that executes adjustment of the machine via the connector module with regard to the at least one adjustment parameter with operation of a user in the adjustment order set by the adjustment parameter setting module.

In response to selection of an object component to be removed or to be replaced among components of the machine, the machine adjustment device of the invention sets at least one adjustment parameter, which requires adjustment accompanied with removal or replacement of the selected object component, as well as an adjustment order of the at least one required adjustment parameter. The machine adjustment device executes adjustment of the machine via the connector module, which connects with the controller of the machine in a communicable manner, with operations of the user with regard to the at least one required adjustment parameter in the preset adjustment order. This arrangement ensures easy, quick, and adequate adjustment of the machine required in the case of removal or replacement of the component in the machine. Here the 'machine' may be a peripheral device that is connectable with a computer, for example, a printer.

In the machine adjustment device of the invention, as one aspect, the component selection module may select the object component to be detached in such a manner that a component once detached for adjustment or repair and attached again is distinguishable from a new component newly attached as replacement of the detached component. In the machine adjustment device of the invention, the adjustment parameter setting module may include an adjustment parameter storage module that stores adjustment parameters mapped to respective components to be detached, and set the at least one adjustment parameter corresponding to the selected object component, based on the mapping of the adjustment parameters to the respective components stored in the adjustment parameter storage module. The adjustment parameter setting module may further include an order relation storage module that stores a relation between ordinal numbers of adjustment and respective adjustment parameters, and set the adjustment order of the at least one adjustment parameter, based on the relation stored in the adjustment order relation storage module.

In the machine adjustment device of the invention, as another aspect, the component selection module may be capable of selecting multiple object components to be detached, and the adjustment parameter setting module, in the case of selection of multiple object components by the component selection module, may set adjustment parameters, which require adjustment accompanied with detachment of the multiple object components, and an adjustment order of the adjustment parameters.

In the machine adjustment device of the invention, the adjustment execution module may execute the adjustment in an interactive manner. The adjustment execution module may further provide documental and pictorial information with regard to factors required for the adjustment. The adjustment execution module may still further enter settings in the machine via the connector module and execute the adjustment with the entered settings. The adjustment execution module may still further execute the adjustment with a predetermined operation of the machine via the connector module. In this case, the adjustment execution module may execute the adjustment with an input value entered by the user, based on a result of the predetermined operation of the machine.

The technique of the present invention is not restricted to the machine adjustment device described above, but is also applicable to a machine adjustment method. Another application of the present invention is a computer program that causes a computer to function as the machine adjustment device.

BRIEF DESCRIPTION OF THE DRAWINGS

FIG. 2 shows an example of the data with regard to the adjustment parameters of the components;

FIG. 3 shows an example of the data with regard to the adjustment order of the adjustment parameters and the relevant matters relating to the adjustment parameters;

FIG. 13 shows an example of a file of relevant matters;

DESCRIPTION OF THE PREFERRED EMBODIMENTS

Figure 1:
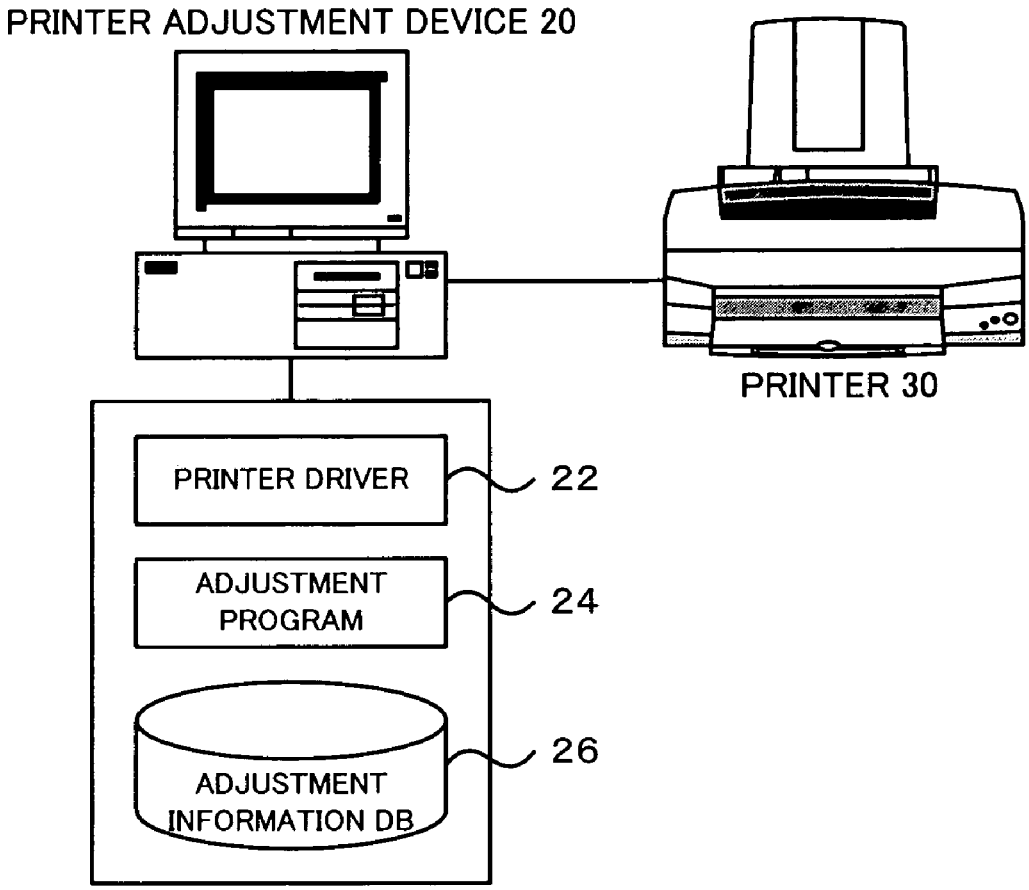
FIG. 1 schematically illustrates the construction of a printer adjustment device 20 in one embodiment of the invention.

One mode of carrying out the invention is discussed below as a preferred embodiment. FIG. 1 schematically illustrates the construction of a printer adjustment device 20 in one embodiment of the invention. As illustrated, the printer adjustment device 20 of the embodiment is actualized by a computer having a CPU. The printer adjustment device 20 has, as functions installed therein, a printer driver 22 that adapts an ink jet printer 30 connecting therewith via a USB or the like, an adjustment program 24 that is executed to adjust the ink jet printer 30, and an adjustment information database 26 that stores information with regard to adjustment parameters of components constituting the ink jet printer 30, an adjustment order of the adjustment parameters, and relevant matters relating to the adjustment parameters in the form of a database.

FIG. 2 shows one example of the data with regard to the adjustment parameters of the components constituting the ink jet printer 30, which are stored in the adjustment information database 26. FIG. 3 shows one example of the data with regard to the adjustment order of the adjustment parameters and the relevant matters relating to the adjustment parameters, which are also stored in the adjustment information database 26. In this embodiment, the data with regard to the adjustment parameters of the components include the name of each component as an object to be 'removed' or 'replaced', the selection of a job between 'removed' and 'replaced', and required adjustment parameters 1 to n. The data with regard to the adjustment order of the adjustment parameters and the relevant matters relating to the adjustment parameters include the required adjustment parameters, absolute ordinal numbers allocated to all the adjustment parameters, and file names given to the relevant matters relating to the adjustment parameters.

Figure 4:
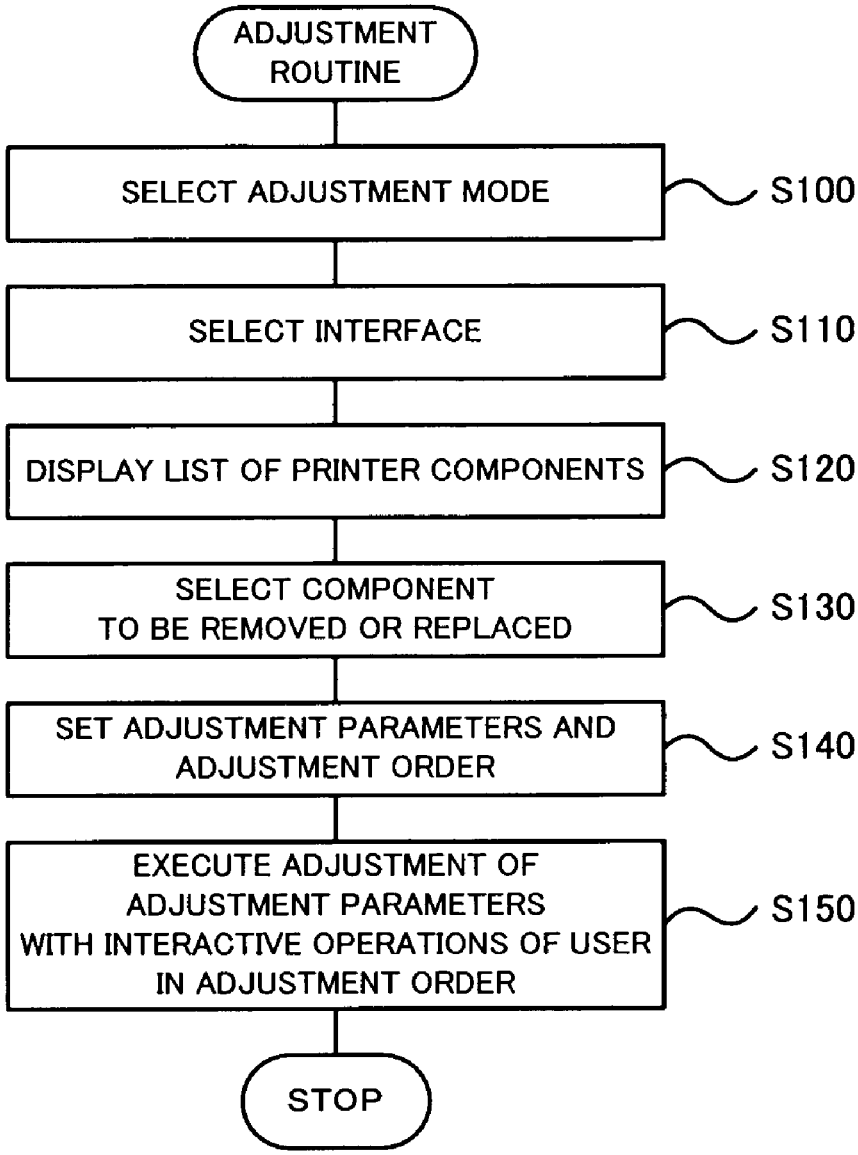
FIG. 4 is a flowchart showing an adjustment routine.
Figure 5:
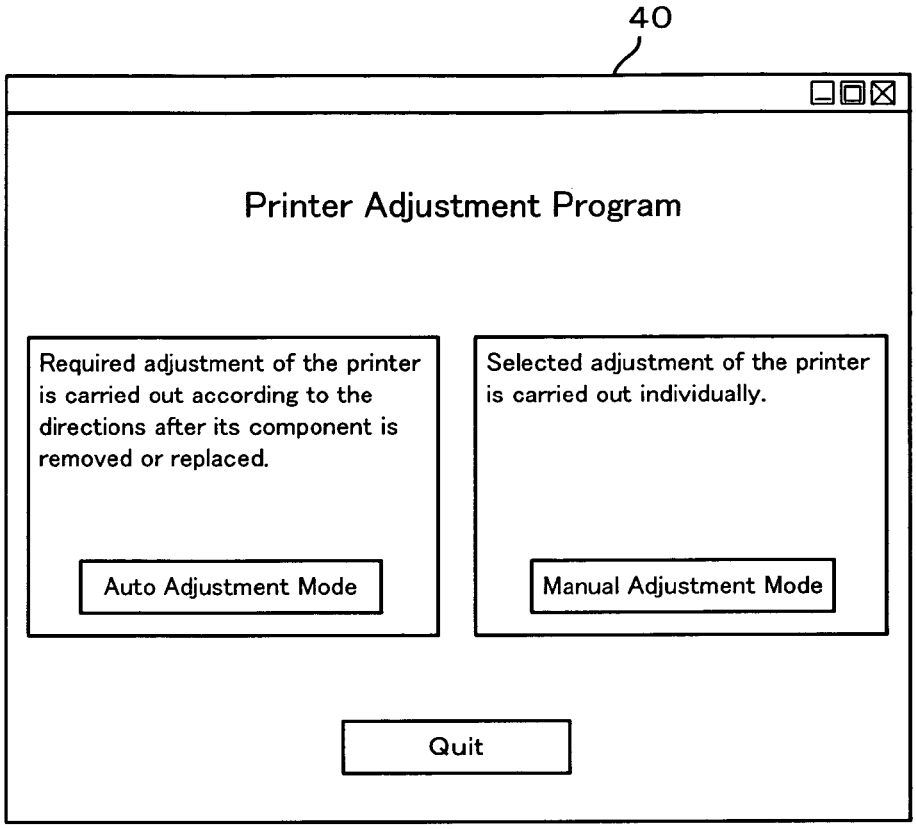
FIG. 5 shows an example of a mode selection window 40.

The printer adjustment device 20 thus constructed operates as discussed below. FIG. 4 is a flowchart showing an adjustment routine executed at the time of activation of the installed adjustment program 24. The adjustment routine first outputs display of a mode selection window 40 shown in FIG. 5 to ask the user to select a desired adjustment mode (step S100). In the structure of the embodiment, selectable options of the adjustment mode are 'auto adjustment mode' that carries out required adjustment of the printer according to the directions after its component is 'removed' or 'replaced' and 'manual adjustment mode' that individually carries out selected adjustment of the printer. The following describes selection of the auto adjustment mode, which is characteristic of the present invention. The manual adjustment mode carries out adjustment of arbitrary adjustment parameters selected by the user among those adjusted in the auto adjustment mode. The adjustment scheme in the manual adjustment mode is similar to the adjustment scheme in the auto adjustment mode, except selection of required adjustment parameters, and is thus not specifically described here. The structure of the embodiment provides the auto adjustment mode and the manual adjustment mode as selectable options, but the manual adjustment mode may be omitted if not necessary.

Figure 6:
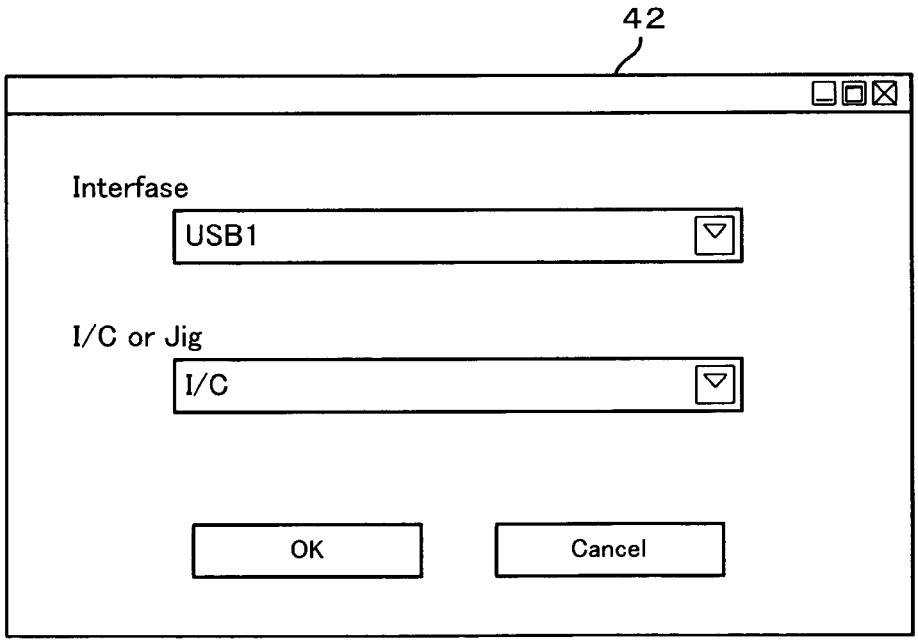
FIG. 6 shows an example of an interface check window 42.
Figure 7:
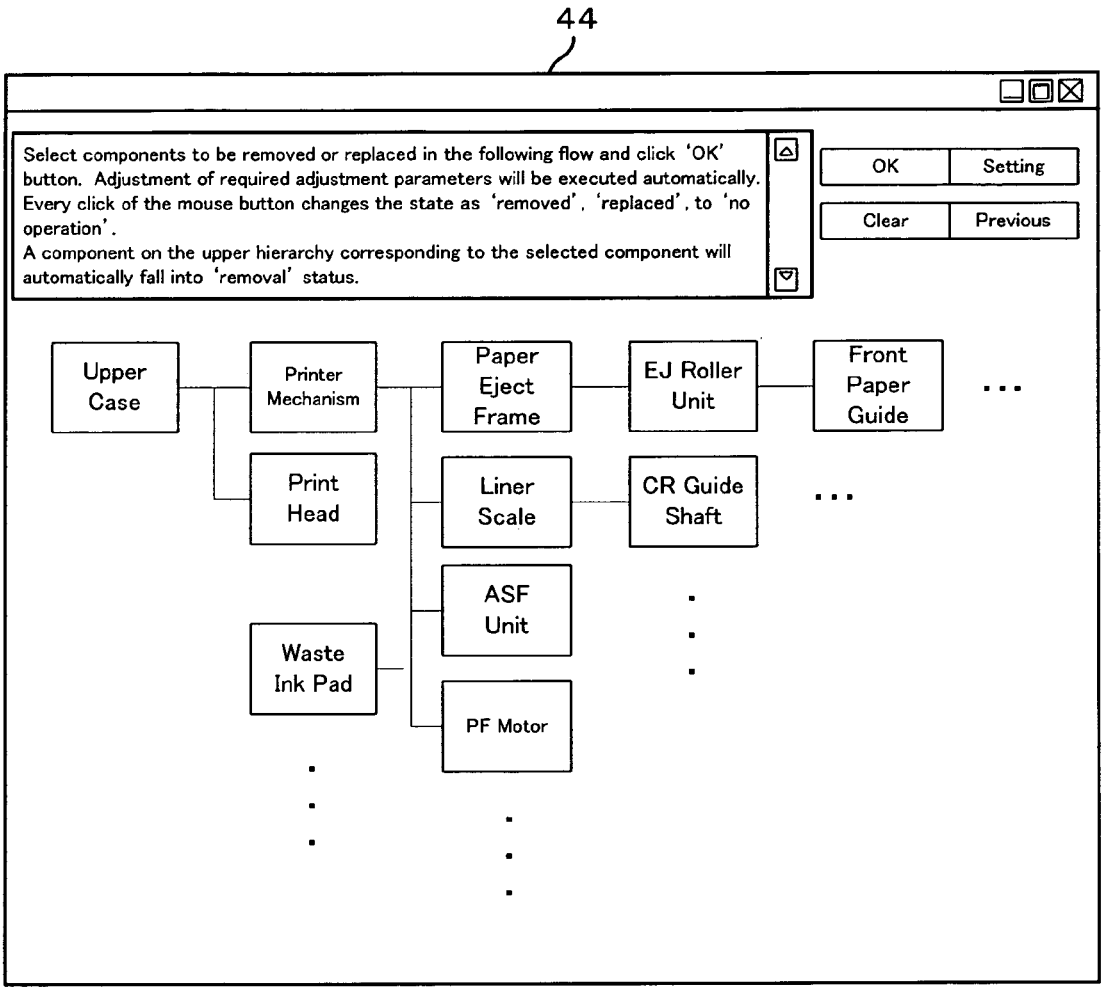
FIG. 7 shows an example of a component selection window 44.
Figure 8:
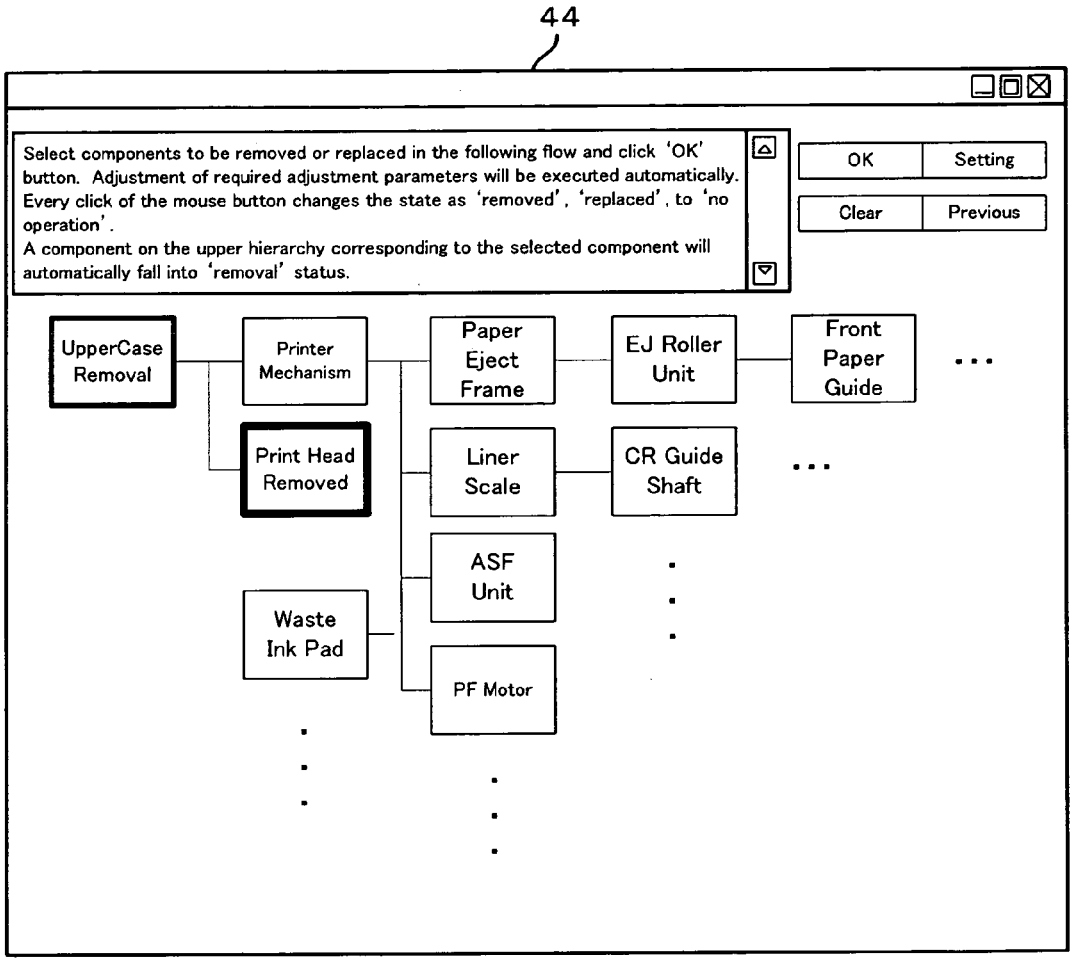
FIG. 8 shows an example of the component selection window 44 where the option 'removed' selectable.

When the user selects the auto adjustment mode at step S100, the adjustment routine outputs display of an interface check window 42 shown in FIG. 6 to ask the user to select an interface used for connection of the printer adjustment device 20 with the ink jet printer 30 and an ink replacement system (either an ink cartridge or a refill with a jig) (step S110). The routine subsequently outputs display of a component selection window 44 (see FIG. 7), which sequentially shows the components of the ink jet printer 30 (step S120) and asks the user to select a target component as an object to be 'removed' or 'replaced' (step S130). Here the terminology 'removed' means that a removed component is attached again to the printer after a required operation like cleaning or without any operation. The terminology 'replaced' means that a new component is attached to the printer as replacement of a removed component. The user selects an object component to be 'removed' or 'replaced' among the components shown in the component selection window 44 by clicking the object component of removal or the object component of replacement with a mouse or another suitable pointing device. In the structure of this embodiment, a single click of the mouse on the object component makes the option 'removed' of the object component selectable (see FIG. 8). A further click of the mouse on the object component in the 'removed' option selectable state makes the option 'replaced' of the object component selectable (see FIG. 9). A click of an 'OK' button (located on the upper right corner in the component selection window 44) in the 'removed' option selectable state or in the 'replaced' option selectable state effectuates selection of either the 'removed' option or the 'replaced' option. The component selection process in the component selection window 44 is discussed in further detail below.

In the component selection window 44 of the embodiment, when a certain component falls either in the 'removed' option selectable state or in the 'replaced' option selectable state, another component that is to be detached to actuate the removal or the replacement of the certain component is set in a 'removal' status. In the component selection window 44 of FIG. 8, a component 'print head' is set in the 'removed' option selectable state by a single click of the mouse on the 'print head', while an upper case that is to be detached to effectuate removal of the print head is set in the removal status. In the component selection window 44 of FIG. 9, the component 'print head' is set in the 'replaced' option selectable state by a further click of the mouse on the 'print head', while the upper case that is to be detached to effectuate replacement of the print head is also set in the removal status.

The component selection window 44 of the embodiment enables the user to select multiple object components to be removed or to be replaced, in the case of simultaneous removal or replacement of the multiple components. In the structure of the embodiment, after a certain component is set in the 'removed' option selectable state or in the 'replaced' option selectable state, a single or a double click of the mouse on another component to be simultaneously removed or replaced sets the multiple components in the 'removed' option selectable state or in the 'replaced' option selectable state. In the component selection window 44 of FIG. 10, two components 'print head' and 'PF motor' are set in the 'replaced' option selectable state. Setting the component 'PF motor' in the 'replaced' option selectable state makes a component 'printer mechanism' fall into the 'removal' status to effectuate replacement of the PF motor.

Figure 11:
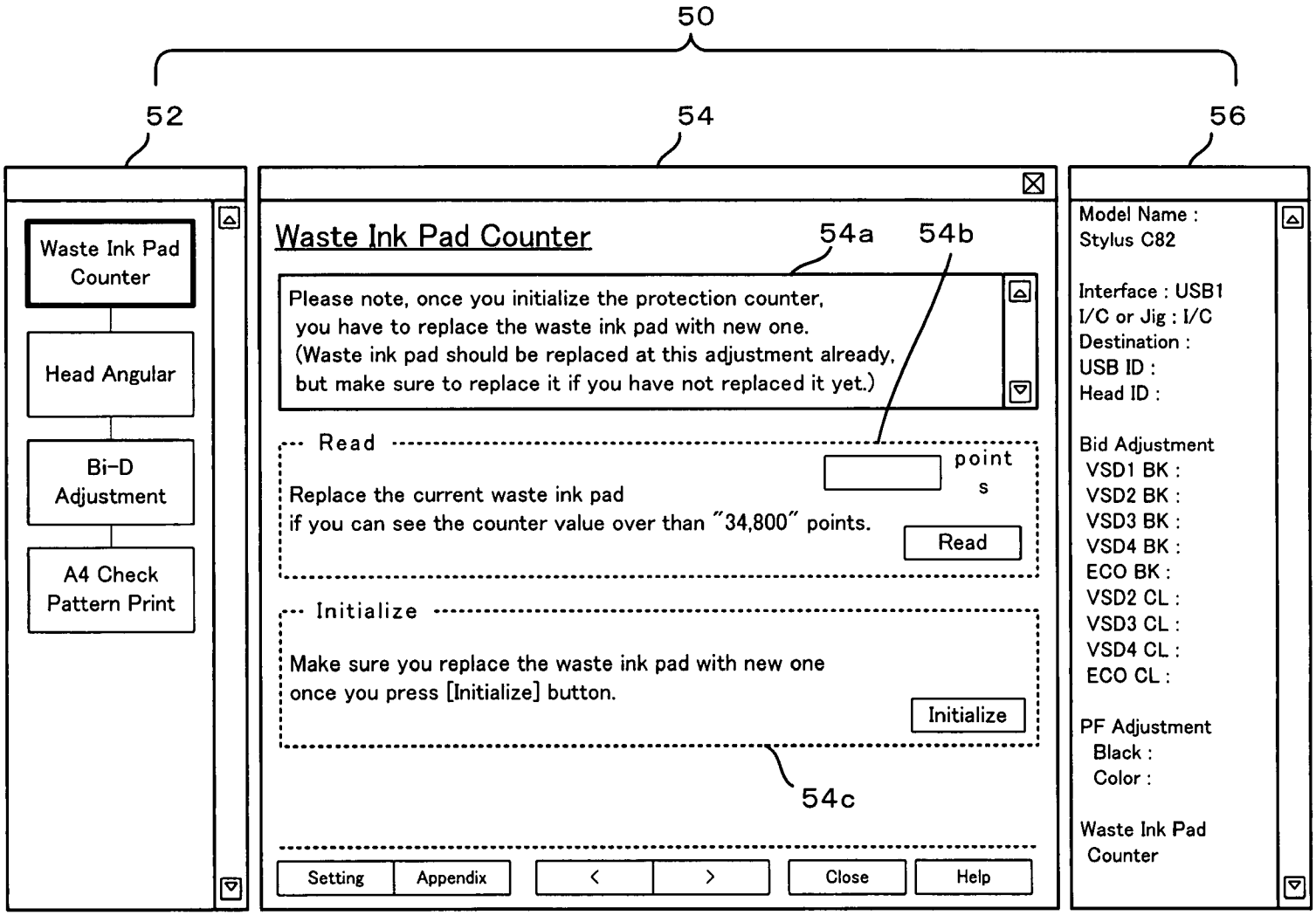
FIG. 11 shows an example of a printer adjustment window 50 for 'Waste Ink Pad Counter'.

Referring back to the flowchart of FIG. 4, after selection of the object component to be removed or to be replaced, the adjustment routine retrieves the adjustment information database 26 with the selected object component as a key to extract adjustment parameters, which require adjustment accompanied with removal or replacement of the selected object component, and to set an adjustment order based on ordinal numbers allocated to the extracted adjustment parameters (step S140). The adjustment routine then interactively executes adjustment of the ink jet printer 30 with operations of the user with regard to the extracted adjustment parameters in the preset adjustment order (step S150). FIG. 11 shows an exemplified display of a printer adjustment window 50 output in response to a click of the 'OK' button in the component selection window 44 that is set in the state of FIG. 8, that is, in response to selection of the 'removed' option of the print head. As illustrated, the printer adjustment window 50 of the embodiment includes a flow window 52 that displays the extracted adjustment parameters in the preset adjustment order, a work window 54 that is used to execute actual adjustment with regard to one of the extracted adjustment parameters, and a display window 56 that shows results of the adjustment.

In the flow window 52, the adjustment parameters extracted at step S140 are displayed in the preset adjustment order sequentially from the top, and the adjustment parameter being currently subjected to actual adjustment in the work window 54 is highlighted to be prominent against the other adjustment parameters. The user can thus visually grasp the extracted adjustment parameters and its order of execution, as well as the current progress in execution flow of the extracted adjustment parameters. In the illustrated example of FIG. 11, there are four adjustment parameters, which are extracted and displayed in a flow to be adjusted in this order. The four adjustment parameters are 'Waste Ink Pad Counter' that reads a count representing the quantity of ink adsorbed by a waste ink pad, replaces the waste ink pad according to the requirements, and initializes the count, 'Head Angular' that adjusts the head angle, 'Bi-D Adjustment' that adjusts the printing position in bidirectional printing, and 'A4 Check Pattern Print' that makes a final inspection of the adjusted ink jet printer 30.

The work window 54 has an adjustment job description field 54*a* that describes a procedure of an adjustment job required for a current adjustment parameter, an input field 54*b* that receives entry of data with regard to the current adjustment parameter from the ink jet printer 30 according to the requirements, and a working field 54*c* that is used to execute the adjustment job of the current adjustment parameter. The user utilizes the input field 54*b* and the working field 54*c* to execute the adjustment job of the current adjustment parameter according to the description in the adjustment job description field 54*a*. In the illustrated example of FIG. 11, the input field 54*b* has a 'Read' button to read a count, which represents the quantity of ink absorbed by a waste ink pad mounted on the ink jet printer 30, from the ink jet printer 30 and a counter display box that shows the count read from the ink jet printer 30 in response to the user's click of the mouse on the 'Read' button. The working field 54*c* has an 'Initialize' button to initialize the count at the time of replacement of the waste ink pad. On completion of the adjustment job of the current adjustment parameter in the work window 54, results of the adjustment are shown in the display window 56. The user can thus check the results of the adjustment shown in the display window 56. When the user clicks a '>' button (corresponding to a 'Next' button) located on the bottom of the work window 54 after completion of the adjustment job of the current adjustment parameter, the flow in the flow window 52 moves to a next adjustment parameter and the display in the work window 54 is changed to the next adjustment parameter. The adjustment job description field 54*a* and the input field 54*b* in the work window 54 are provided as text data. This arrangement allows for preparation of the description in these fields 54*a* and 54*b* corresponding to the language used in the region where the adjustment program 24 is executed, and ensures quick and easy update of the description in these fields 54*a* and 54*b*.

Figure 12:
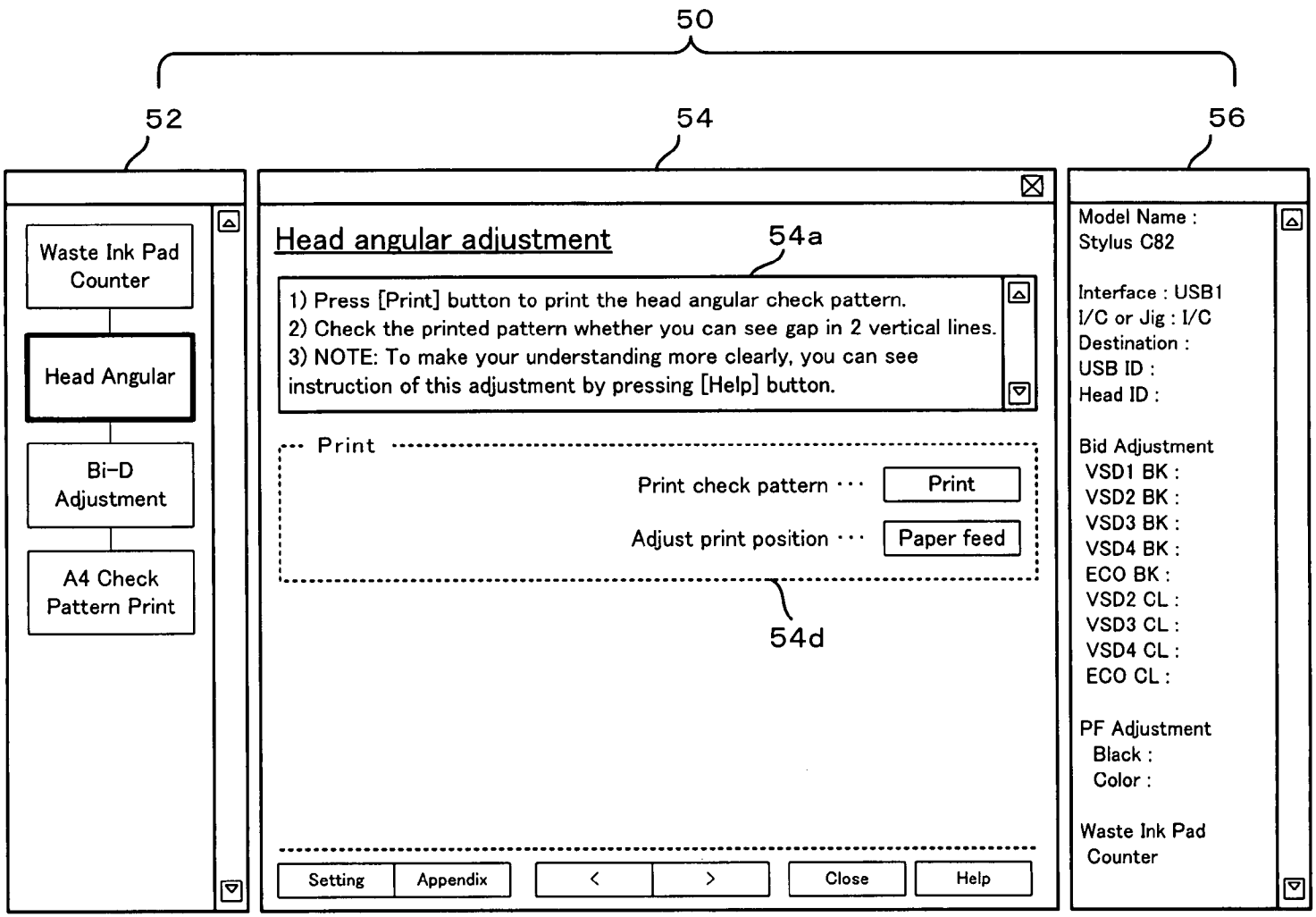
FIG. 12 shows an example of the printer adjustment window 50 for 'Head Angular Adjustment'.

FIG. 12 shows an exemplified display of the printer adjustment window 50 corresponding to the second adjustment parameter 'Head Angular', which is output in response to a click of the '>' button on the bottom of the work window 54 in the printer adjustment window 50 of FIG. 11. As illustrated, the current adjustment parameter 'Head Angular' is highlighted in the flow window 52, and the completed adjustment parameter 'Waste Ink Pad Counter' is displayed in a different color from the color of non-processed adjustment parameters. In the printer adjustment window 50 corresponding to the second adjustment parameter 'Head Angular', the work window 54 has an operation execution field 54*d* that causes the ink jet printer 30 to print a check pattern. The user adjusts the head angle, based on a print of the check pattern by the ink jet printer 30. In the illustrated example of FIG. 12, the operation execution field 54*d* has a 'Print' button to direct the ink jet printer 30 to print a check pattern and a 'Paper Feed' button to adjust the printing position. As described above, in the printer adjustment device 20 of the embodiment, the work window 54 has the operation execution field 54*d* that is used to make the ink jet printer 30 carry out a predetermined operation, according to the procedure of the adjustment job with regard to the current adjustment parameter. The appropriate adjustment of the current adjustment parameter is implemented by execution of the predetermined operation by the ink jet printer 30. A click of the mouse on an instruction button (the 'Print' button in the illustrated example of FIG. 12) in the operation execution field 54*d* causes the printer adjustment device 20 to give an execution instruction of a predetermined operation (printing of a check pattern in the illustrated example of FIG. 12) to the control system of the ink jet printer 30. The ink jet printer 30 accordingly executes the predetermined operation (printing of the check pattern in the illustrated example of FIG. 12).

The work window 54 also has a 'Help' button. In response to a click of the 'Help' button, a file of relevant matters relating to the current adjustment parameter is shown in a separate window from the printer adjustment window 50. The user can thus implement adjustment by referring to the relevant matters relating to the current adjustment parameter, for example, the significance of the adjustment, the required operations for the adjustment, and the judgment on the predetermined operation executed by the ink jet printer 30. FIG. 13 shows display of a file of relevant matters relating to the current adjustment parameter 'Head Angular'.

Figure 14:
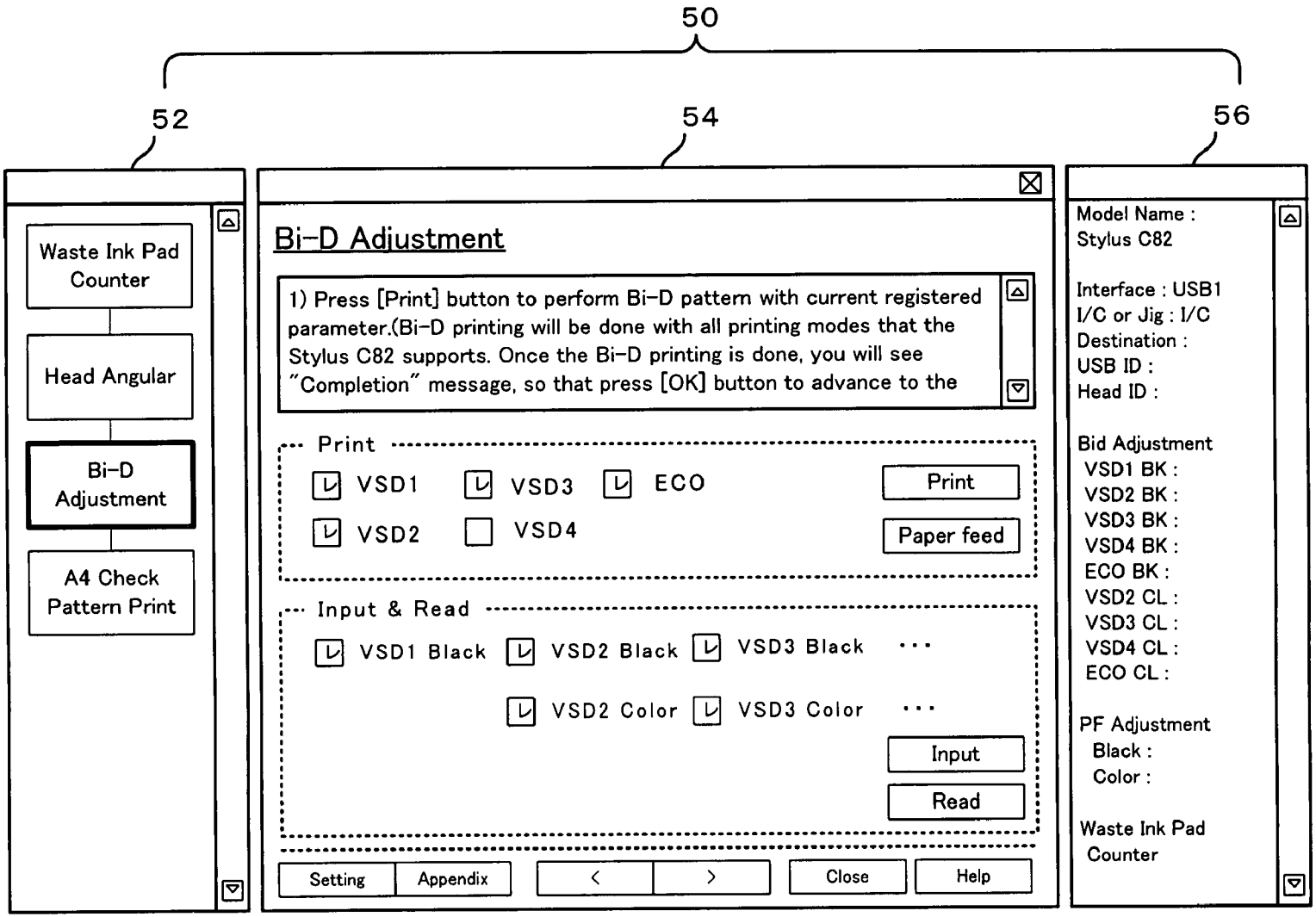
FIG. 14 shows an example of the printer adjustment window 50 for 'Bi-D Adjustment'.
Figure 15:
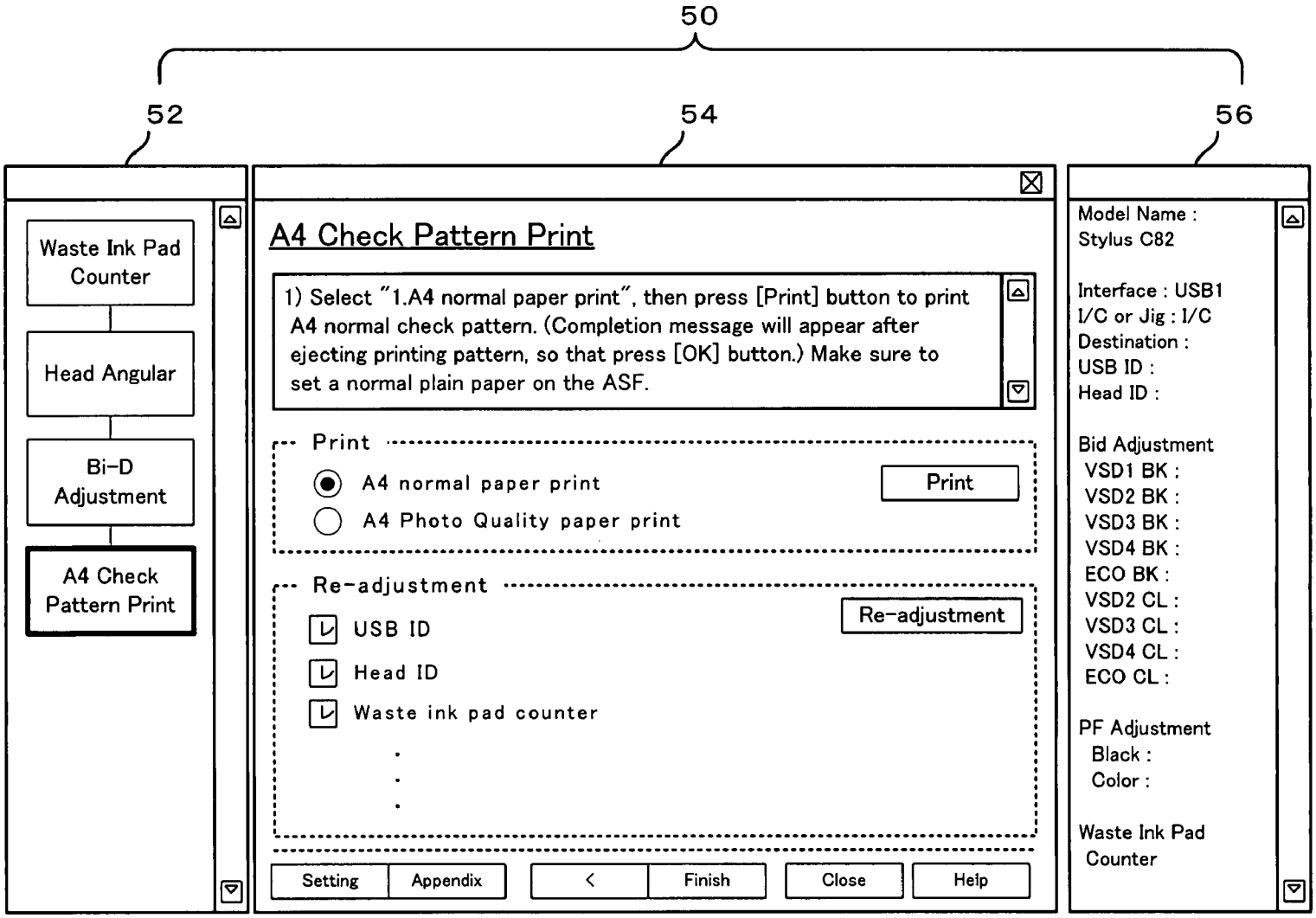
FIG. 15 shows an example of the printer adjustment window 50 for 'A4 Check Pattern Print'.

FIG. 14 shows an exemplified display of the printer adjustment window 50 corresponding to the adjustment parameter 'Bi-D Adjustment'. FIG. 15 shows an exemplified display of the printer adjustment window 50 corresponding to the adjustment parameter 'A4 Check Pattern Print'. As shown in FIG. 15, the procedure of the embodiment enables the ink jet printer 30 to print the check pattern again at the time of completion of the series of adjustment procedure to allow for readjustment of the ink jet printer 30. A click of the mouse on a 'Finish' button located on the bottom of the work window 54 in the printer adjustment window 50 corresponding to the adjustment parameter 'A4 Check Pattern Print' completes the adjustment procedure of all the adjustment parameters with regard to the selected object component and terminates the series of adjustment flow.

Figure 9:
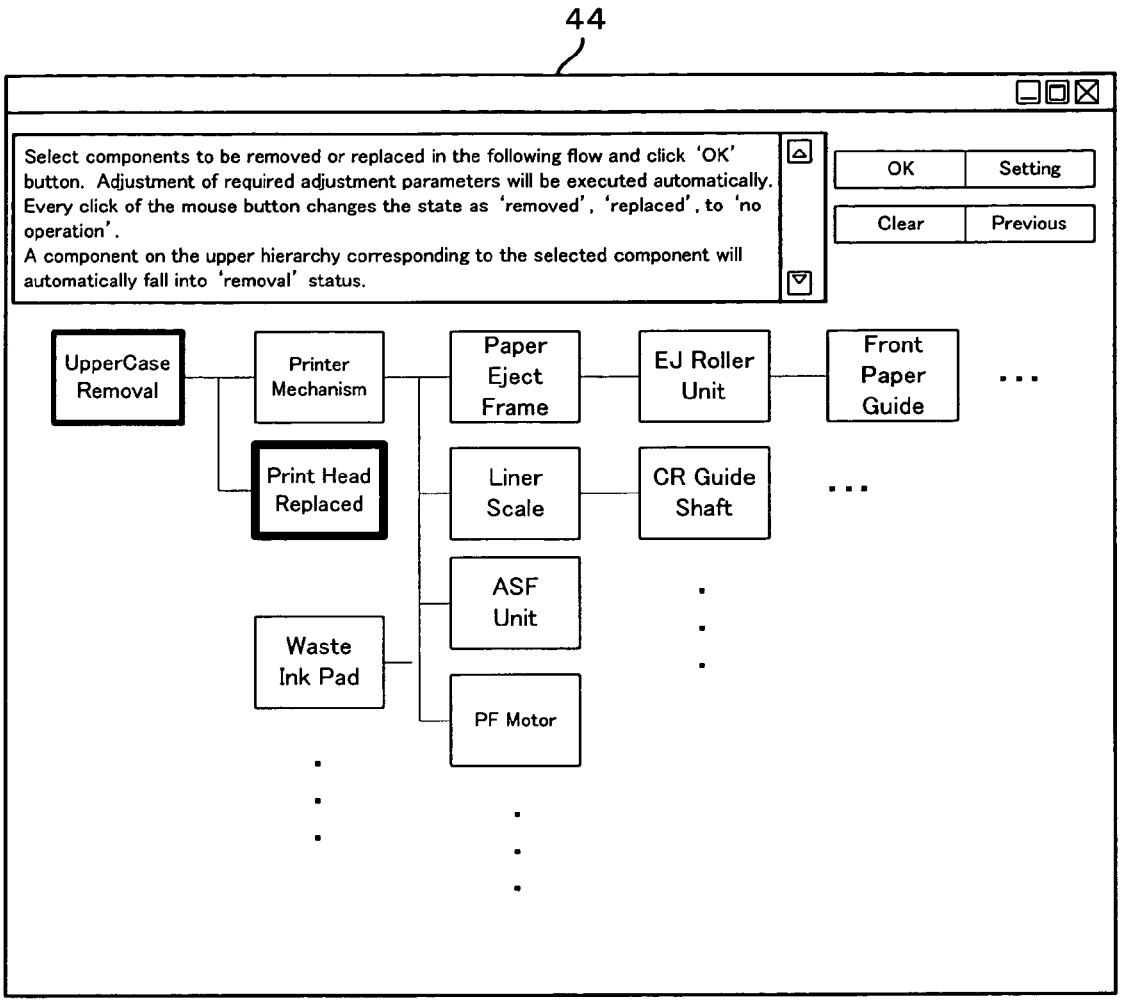
FIG. 9 shows an example of the component selection window 44 where the option 'replaced' selectable.
Figure 16:
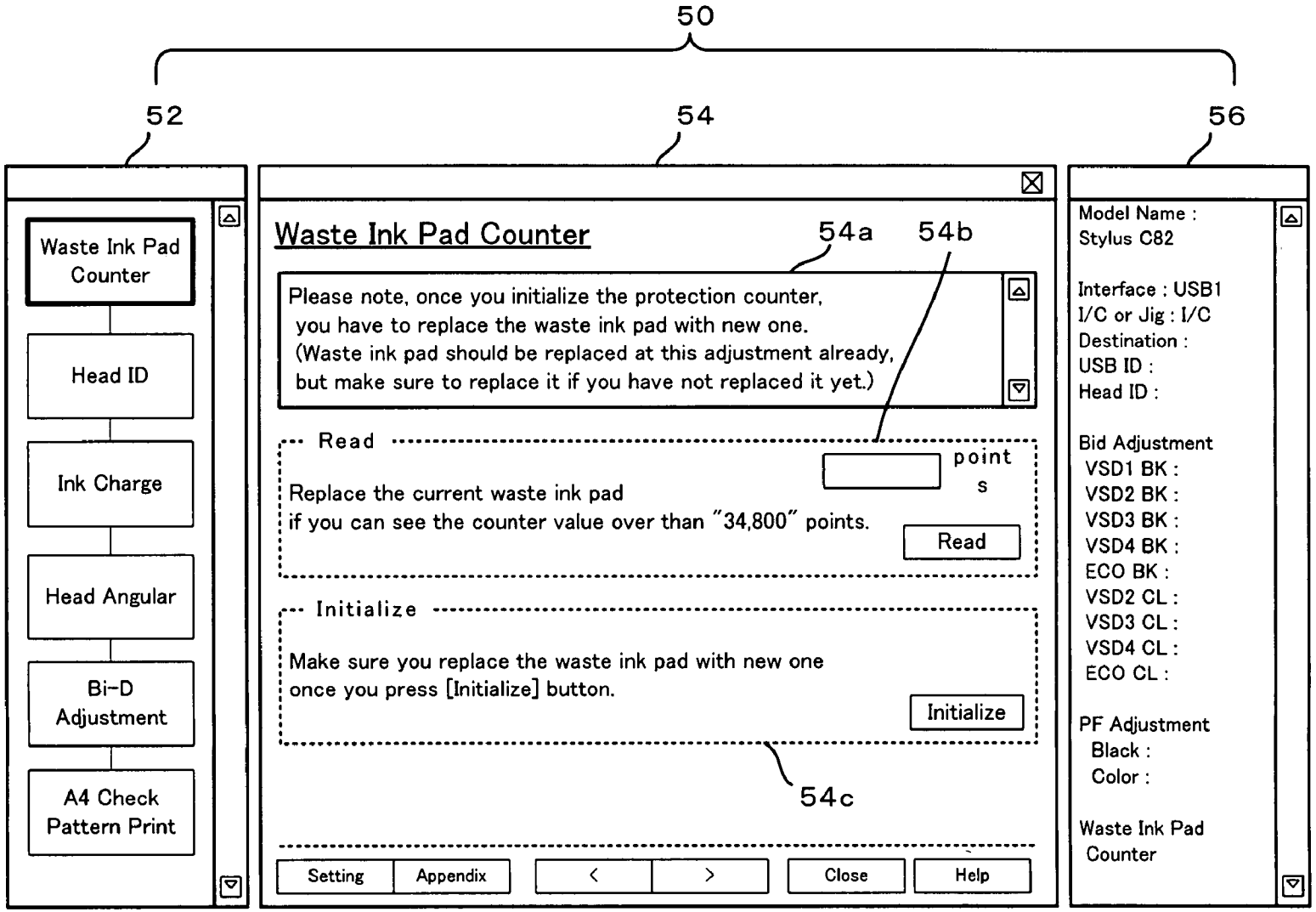
FIGS. 16 and 17 show examples of the printer adjustment window 50.

FIG. 16 shows an exemplified display of the printer adjustment window 50 output in response to a click of the 'OK' button in the component selection window 44 that is set in the state of FIG. 9, that is, in response to selection of the 'replaced' option of the print head. As clearly understood from the comparison between the flow windows 52 in the printer adjustment windows 50 of FIGS. 11 and 16, an adjustment parameter 'Head ID' that adjusts a variation of the print head and an adjustment parameter 'Ink Charge' that regulates ink charge into the print head are added between the adjustment parameter 'Waste Ink Pad Counter' and the adjustment parameter 'Head Angular' in the case of selection of the 'replaced' option of the print head. This is because the adjustment parameters required for removal of the print head are different from those required for replacement of the print head.

Figure 10:
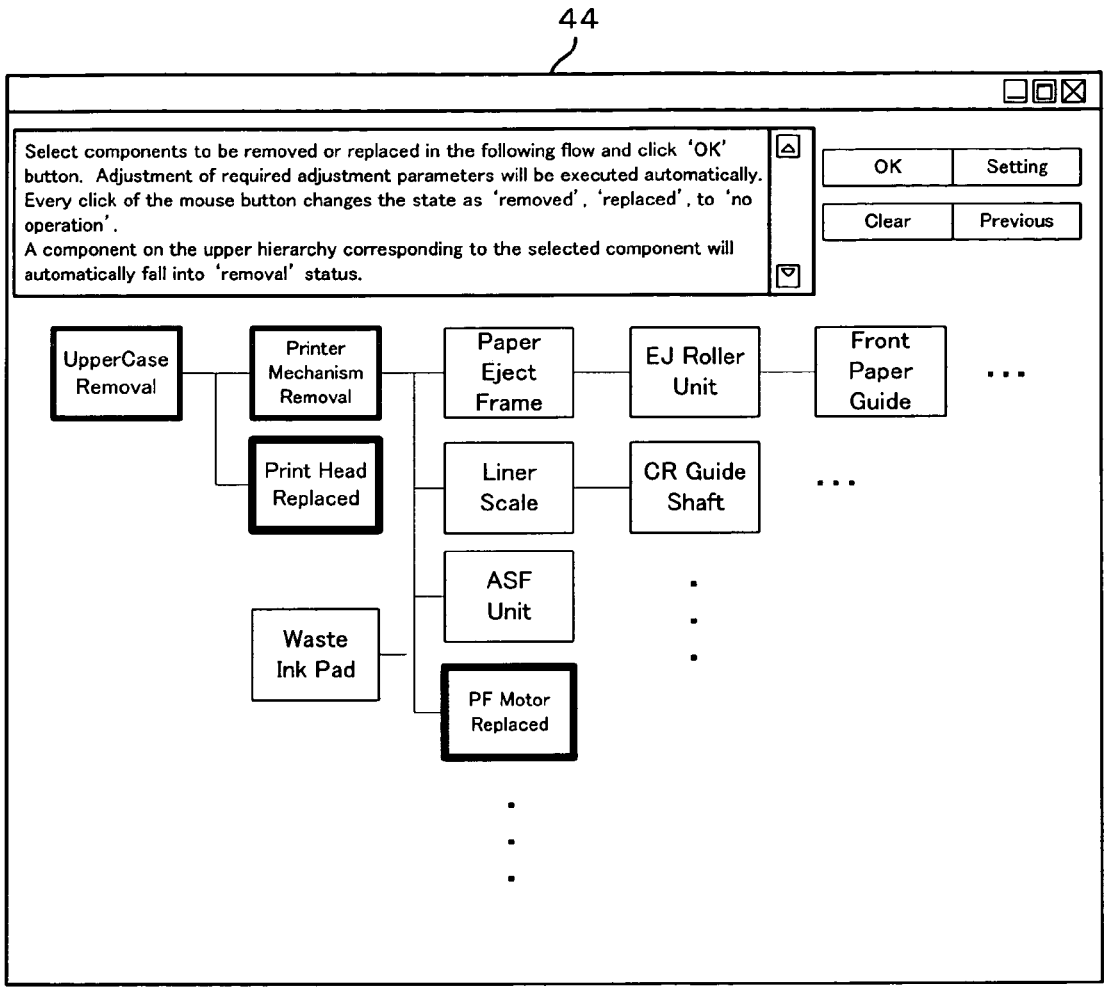
FIG. 10 shows an example of the component selection window 44 where multiple object components are selectable.
Figure 17:
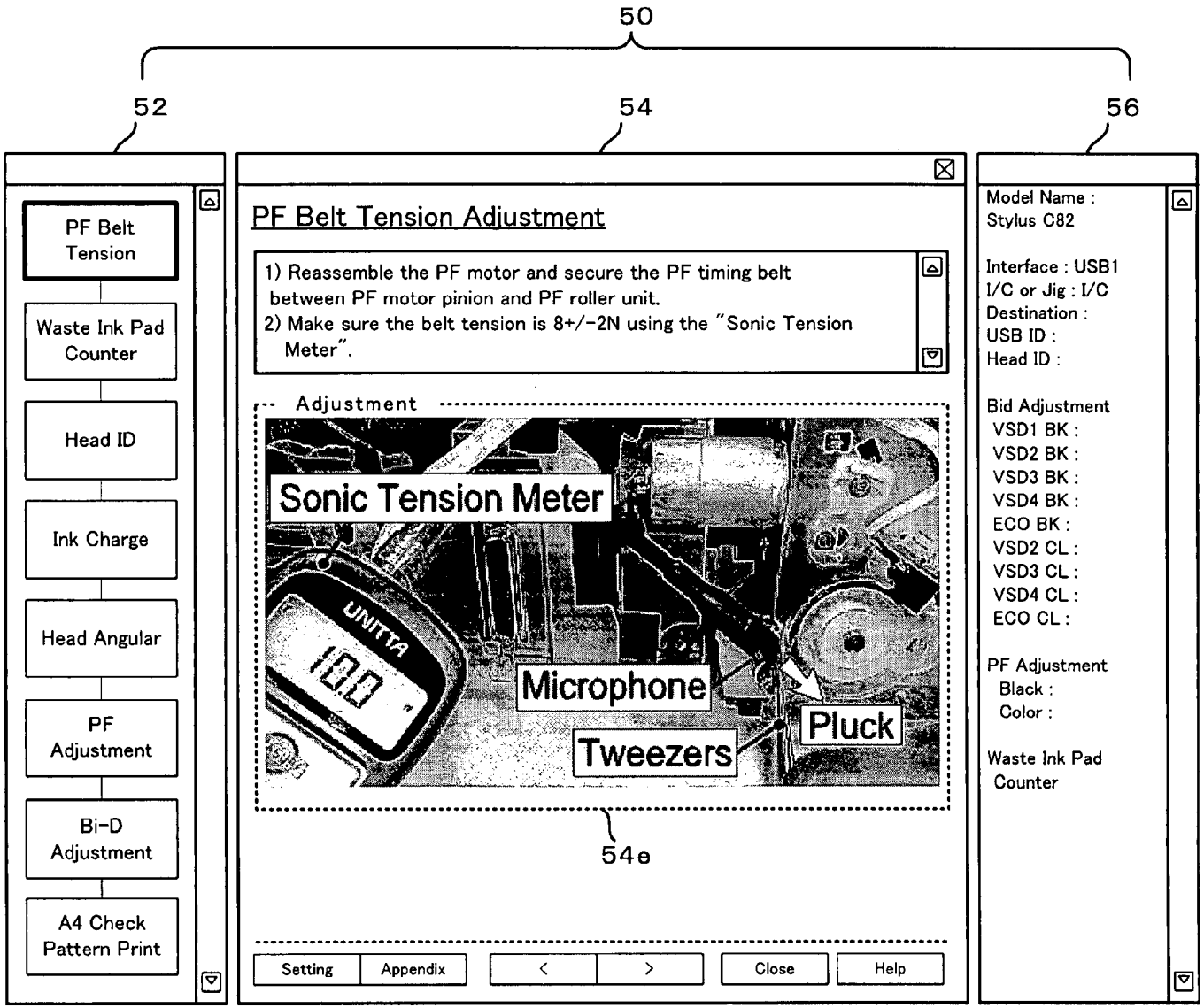

FIG. 17 shows an exemplified display of the printer adjustment window 50 output in response to a click of the 'OK' button in the component selection window 44 that is set in the state of FIG. 10, that is, in response to selection of the 'replaced' option of the print head and the 'replaced' option of the PF motor. As illustrated, adjustment parameters required for replacement of the print head and the PF motor are shown in a required adjustment order in the flow window 52. In the illustrated example of FIG. 17, the work window 54 has an image display field 54*e* to display an image required for the adjustment job, when necessary. The user can check both the displayed image and the actual ink jet printer 30 for adjustment. This arrangement ensures adequate adjustment of the ink jet printer 30.

As described above, the printer adjustment device 20 of the embodiment ensures adequate adjustment of the ink jet printer 30 required in the case of removal or replacement of a component included in the ink jet printer 30. The interactive display enables even an unskilled user to readily and quickly implement adjustment of the ink jet printer 30. In the case of selection of multiple components to be removed or to be replaced, the printer adjustment device 20 extracts adjustment parameters required for removal or replacement of the selected multiple components and sets an adjustment order of the extracted adjustment parameters, based on the ordinal numbers of adjustment allocated to the respective adjustment parameters. This arrangement ensures quick and adequate adjustment of the ink jet printer 30 required in the case of removal or replacement of the multiple components, while eliminating duplicate of adjustment.

In the printer adjustment device 20 of the embodiment, an adjustment flow including required adjustment parameters in a preset adjustment order with regard to a selected object component is shown in the flow window 52 of the printer adjustment window 50. A current adjustment parameter, which is being currently adjusted, is highlighted in the display. This arrangement visually informs the user of the required adjustment parameters for the selected object component, as well as of the current progress in the adjustment flow.

The printer adjustment device 20 of the embodiment reads data required for adjustment of the extracted adjustment parameters from the ink jet printer 30 and carries out adjustment with the data. This arrangement ensures the adequate adjustment of the ink jet printer 30. The printer adjustment device 20 of the embodiment causes the ink jet printer 30 to carry out a predetermined operation according to the requirement and implements adjustment of an adjustment parameter based on the result of the predetermined operation. This enhances the adequacy of adjustment of the ink jet printer 30. The reference image is displayed in the image display filed 54*e* according to the requirements, and the file of relevant matters relating to the current adjustment parameter is displayed in a separate window in response to a click of the 'Help' button. This arrangement enables even an unskilled user to readily and adequately implement adjustment of the ink jet printer 30.

The USB connection for connecting the printer adjustment device 20 with the ink jet printer 30 in the structure of the embodiment corresponds to the connector module of the invention. Selection of one or multiple components in the component selection window 44 shown in FIG. 7 through the user's operations of the keyboard or the mouse of the computer functioning as the printer adjustment device 20 corresponds to the component selection module of the invention. The process of extracting the adjustment parameters and setting the adjustment order at step S140 in the adjustment routine of FIG. 4 corresponds to the adjustment parameter setting module of the invention. Execution of the adjustment with the printer adjustment window 50 of FIGS. 11 through 17 at step S150 in the adjustment routine of FIG. 4 corresponds to the adjustment execution module of the invention.

The printer adjustment device 20 of the embodiment selects a component to be replaced distinguishably from a component to be removed. One modified procedure may carry out an identical procedure of adjustment for both removal and replacement of a selected component. The printer adjustment device 20 of the embodiment is capable of selecting multiple components to be removed or to be replaced, but selection of only one component may be allowed.

The printer adjustment device 20 of the embodiment displays an image or description of relevant matters according to the requirements to assist the user's adjustment job. Display of the image or the description of relevant matters is, however, not essential.

In the embodiment discussed above, the printer adjustment device 20 carries out adjustment of the ink jet printer 30. The target machine of adjustment is not restricted to the ink jet printer, but may be any of other diverse printers like a color laser printer or any of other diverse image formation devices like a photocopier. The target machine of adjustment may also be a peripheral device of a computer other than the printer, for example, a scanner, or a device other than the peripheral device of the computer.

The embodiment regards the printer adjustment device 20 that is actuated to adjust the ink jet printer 30. The technique of the invention is also actualized by a printer adjustment method carried out in the printer adjustment device 20 of the embodiment or by a program that causes a computer to function as the printer adjustment device 20 of the embodiment. In the latter case, the respective steps of the adjustment routine shown in the flowchart of FIG. 4 are programmed in an adequate programming language.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

What is claimed is:

1. A machine adjustment device that adjusts a machine, said machine adjustment device comprising:

a connector module that connects with a controller of said machine in a communicable manner;

a component selection module that selects an object component to be detached among components of said machine;

an adjustment parameter setting module that sets at least one adjustment parameter, which requires adjustment accompanied with detachment of the selected object component, as well as an adjustment order of the at least one adjustment parameter, said adjustment parameter setting module including an order relation storage module that stores a relation between ordinal numbers of adjustment and respective adjustment parameters, and said adjustment parameter setting module setting the adjustment order of the at least one adjustment parameter, based on the relation stored in said order relation storage module; and an adjustment execution module that executes adjustment of said machine via said connector module with regard to the at least one adjustment parameter with operation of a user in the adjustment order set by said adjustment parameter setting module.

2. A machine adjustment device in accordance with claim 1, wherein said component selection module selects the object component to be detached in such a manner that a component once detached for adjustment or repair and attached again is distinguishable from a new component newly attached as replacement of the detached component.

3. A machine adjustment device in accordance with claim 1, wherein said adjustment parameter setting module comprises an adjustment parameter storage module that stores adjustment parameters mapped to respective components to be detached, and said adjustment parameter setting module sets the at least one adjustment parameter corresponding to the selected object component, based on the mapping of the adjustment parameters to the respective components stored in said adjustment parameter storage module.

4. A machine adjustment device in accordance with claim 1, wherein said component selection module is capable of selecting multiple object components to be detached, and said adjustment parameter setting module, in the case of selection of multiple object components by said component selection module, sets adjustment parameters, which require adjustment accompanied with detachment of the multiple object components, and an adjustment order of the adjustment parameters.

5. A machine adjustment device in accordance with claim 1, wherein said adjustment execution module executes the adjustment in an interactive manner.

6. A machine adjustment device in accordance with claim 1, wherein said adjustment execution module provides documental and pictorial information with regard to factors required for the adjustment.

7. A machine adjustment device in accordance with claim 1, wherein said adjustment execution module enters settings in said machine via said connector module and executes the adjustment with the entered settings.

8. A machine adjustment device in accordance with claim 1, wherein said adjustment execution module executes the adjustment with a predetermined operation of said machine via said connector module.

9. A machine adjustment device in accordance with claim 8, wherein said adjustment execution module executes the adjustment with an input value entered by the user, based on a result of the predetermined operation of said machine.

10. A machine adjustment device in accordance with claim 1, wherein said machine is a peripheral device that is connectable with a computer.

11. A machine adjustment device in accordance with claim 10, wherein said machine is a printer.

12. A machine adjustment method that carries out adjustment of a machine with a computer, said machine adjustment method comprising the steps of:

(a) causing the computer to connect with a controller of said machine in a communicable manner;

(b) selecting an object component to be detached among components of said machine and inputting the selection of the object component into the computer;

(c) causing the computer to extract at least one adjustment parameter, which requires adjustment accompanied with detachment of the selected object component, among multiple adjustment parameters that are stored in advance in the computer, and to set an adjustment order of the at least one extracted adjustment parameter, the causing of the computer to extract at least one adjustment parameter including storing in advance a relation between ordinal numbers of adjustment and respective adjustment parameters and setting the adjustment order of the at least one extracted adjustment parameter, based on the stored relation; and (d) causing the computer to execute adjustment of said machine with regard to the at least one extracted adjustment parameter with operation of a user in the preset adjustment order.

13. A machine adjustment method in accordance with claim 12, wherein said step (b) selects the object component to be detached in such a manner that a component once detached for adjustment or repair and attached again is distinguishable from a new component newly attached as replacement of the detached component, and inputs the selection of the object component into the computer.

14. A machine adjustment method in accordance with claim 12, wherein said step (c) stores adjustment parameters mapped to respective components to be detached, and sets the at least one adjustment parameter corresponding to the selected object component, based on the mapping of the adjustment parameters to the respective components stored in the computer.

15. A machine adjustment method in accordance with claim 12, wherein said step (b) is capable of selecting multiple object components to be detached, and said step (c), in the case of selection of multiple object components in said step (b), sets adjustment parameters, which require adjustment accompanied with detachment of the multiple object components, and an adjustment order of the adjustment parameters.

16. A machine adjustment method in accordance with claim 12, wherein said step (d) executes the adjustment in an interactive manner.

17. A machine adjustment method in accordance with claim 12, wherein said step (d) provides documental and pictorial information with regard to factors required for the adjustment.

18. A machine adjustment method in accordance with claim 12, wherein said step (d) enters settings in said machine connected by said step (a) and executes the adjustment with the entered settings.

19. A machine adjustment method in accordance with claim 12, wherein said step (d) executes the adjustment with a predetermined operation of said machine connected by said step (a).

20. A machine adjustment method in accordance with claim 19, wherein said step (d) executes the adjustment with an input value entered by the user, based on a result of the predetermined operation of said machine.

* * * * *